US006853265B2

(12) United States Patent
Arakawa et al.

(10) Patent No.: US 6,853,265 B2
(45) Date of Patent: Feb. 8, 2005

(54) DIELECTRIC RESONATOR DEVICE, DIELECTRIC FILTER, DIELECTRIC DUPLEXER, AND COMMUNICATION APPARATUS

(75) Inventors: Shigeji Arakawa, Nagaokakyo (JP); Tatsuya Tsujiguchi, Kanazawa (JP); Munehisa Watanabe, Ishikawa-ken (JP); Yukihiro Kitaichi, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 73 days.

(21) Appl. No.: 10/361,683

(22) Filed: Feb. 11, 2003

(65) Prior Publication Data

US 2003/0151475 A1 Aug. 14, 2003

(30) Foreign Application Priority Data

Feb. 12, 2002 (JP) ..... 2002-034376
Nov. 18, 2002 (JP) ..... 2002-334225

(51) Int. Cl.[7] ..... H01P 5/12; H01P 1/213
(52) U.S. Cl. ..... 333/134; 333/202
(58) Field of Search ..... 333/202, 134, 333/219.1, 219, 26, 33

(56) References Cited

U.S. PATENT DOCUMENTS 6,057,745 A * 5/2000 Sonoda et al. ..... 333/134
6,184,758 B1 2/2001 Ishikawa et al. ..... 333/134
6,236,291 B1 * 5/2001 Sonoda et al. ..... 333/202
2002/0027483 A1 * 3/2002 Sasaki et al. ..... 333/134

FOREIGN PATENT DOCUMENTS

JP 10-031142 2/1998
JP 11 234008 8/1999

* cited by examiner

*Primary Examiner*—Dinh T. Le
(74) *Attorney, Agent, or Firm*—Dickstein, Shapiro, Morin & Oshinsky, LLP.

(57) ABSTRACT

A dielectric resonator device includes a dielectric plate. An electrode is provided on each of both principal surfaces of the dielectric plate and a plurality of pairs of mutually-opposing electrode openings are formed in the electrodes. Accordingly, the dielectric resonator device functions as a three-stage resonator. Strip lines serving as input/output probes are provided on the upper surface of an input/output substrate. Also, a ground electrode having electrode openings are formed thereon. By providing the dielectric resonator device and an upper substrate on the upper surface of the input/output substrate, a dielectric filter is formed.

9 Claims, 13 Drawing Sheets

SOLID LINE: DIRECTION OF ELECTRIC FIELD
BROKEN LINE: DIRECTION OF MAGNETIC FIELD

ARROW: DIRECTION OF ELECTRIC FIELD

SOLID LINE: DIRECTION OF ELECTRIC FIELD
BROKEN LINE: DIRECTION OF MAGNETIC FIELD

SOLID LINE: DIRECTION OF ELECTRIC FIELD
BROKEN LINE: DIRECTION OF MAGNETIC FIELD

DIELECTRIC RESONATOR DEVICE, DIELECTRIC FILTER, DIELECTRIC DUPLEXER, AND COMMUNICATION APPARATUS

BACKGROUND OF THE INVENTION

1. Field of the Invention

The present invention relates to a dielectric resonator device including a dielectric plate having a plurality of resonance regions, and to a dielectric filter, a dielectric duplexer, and a communication apparatus including the dielectric resonator device.

2. Description of the Related Art

Japanese Unexamined Patent Application Publication No. 11-234008 discloses a known flat-circuit dielectric resonator device. The dielectric resonator device includes a dielectric plate. An electrode is provided on each of both principal surfaces of the dielectric plate and mutually-opposing openings are formed in the electrodes. An electrode opening functioning as a resonator of an input/output unit is formed in a slot shape extending in the direction of each end surface of mutually-opposing shorter-sides of the dielectric plate. Also, the resonators are linearly aligned in the direction parallel to a magnetic field direction when the resonators couple in a magnetic field.

FIGS. 13A and 13B show the configuration of the dielectric resonator device. Herein, reference numeral 2 denotes an electrode which is formed on the upper surface of the dielectric plate and which includes electrode openings 4*a*, 4*b*, and 4*c*. This dielectric resonator device includes a three-stage resonance region. The first and third stages on both sides serve as resonators using the electrode openings 4*a* and 4*c*, one edge of the openings 4*a* and 4*c* being open in the shorter-sides of the dielectric plate. The second stage serves as a resonator using the electrode opening 4*b*, both edges thereof being closed so as to form a rectangular shape.

A used resonance frequency is defined so that the following expressions are satisfied: L=about (2n−1)/4 wavelength (n is an integer which is one or more, and L is the length in the longer-side direction of each resonator) when one edge is opened, and L=about n/2 wavelength (n is an integer which is one or mode) when the both edges are closed so as to form a rectangular shape.

Further, input/output coupling probes 11 and 12 connected to an input/output terminal are provided in a direction perpendicular to the magnetic field of the resonator defined by the electrode openings, at the open-end side of the electrode openings 4*a* and 4*c*.

The above-described dielectric resonator device can be used as a very compact and lightweight filter. However, if a filter having a different resonance frequency fo is designed in a system of the same frequency band by using the configuration shown in FIG. 13A, the length of the longer-side of the dielectric plate must be changed. For example, as shown in FIG. 13B, when fo is decreased, the length L in the longer-side direction of the electrode openings 4*a*, 4*b*, and 4*c* increases to L'. Accordingly, the length of the dielectric plate increases and the size of the filter also increases. As a result, the position of the input/output terminal must be changed and standardization of a mounting pattern on a circuit board cannot be realized.

The standardization can be realized if the filter is designed to be large considering the change in the size of the dielectric plate. In that case, however, needs for miniaturization cannot be satisfied.

SUMMARY OF THE INVENTION

An object of the present invention is to provide a dielectric resonator device in which a different resonance frequency fo can be used without increasing the size so as to achieve standardization, and to provide a dielectric filter, a dielectric duplexer, and a communication apparatus including the dielectric resonator device.

A dielectric resonator device of the present invention comprises a substantially rectangular dielectric plate; an electrode provided on each of both principal surfaces of the dielectric plate; and a plurality of pairs of mutually-opposing openings formed in the electrodes. Respective portions between the mutually-opposing openings are defined as main resonance regions, which function as a plurality of resonators. Each of the openings defining the resonance region of the resonator for externally inputting/outputting a signal is substantially rectangular, and at least one edge of the opening is located at one edge of the dielectric plate.

With this configuration, the length in the longer-side direction of the dielectric plate need not be changed even when a resonator device having a different resonance frequency fo is to be formed. Therefore, the size of the dielectric resonator device does not increase and the components can be standardized.

Also, a magnetic field with respect to stick-like input/output probes or strip lines serving as input/output probes couples the respective resonators and the input/output probes. Accordingly, a strong external coupling can be obtained and insertion loss can be reduced.

Preferably, an edge of the openings for defining the resonance region of the resonator other than the resonator for inputting/outputting the signal and an edge of the openings for defining the resonance region of the resonator for inputting/outputting the signal are open in the same edge of the dielectric plate.

Preferably, an electrically open end of the resonator other than the resonator for inputting/outputting the signal and an electrically open end of the resonator for inputting/outputting the signal are located at the same edge of the dielectric plate.

With this configuration, even if a dielectric resonator device having a resonator of three or more stages and having different resonance frequencies is formed, the length in the longer-side direction of the dielectric plate, that is, the length in the alignment direction of the resonators, need not be increased, and thus a compact resonator device can be realized.

Preferably, mutually-opposing edges of each of the openings for defining the resonance region of the resonator other than the resonator for inputting/outputting the signal are open in mutually-opposing edges of the dielectric plate.

Preferably, mutually-opposing electrically open ends of the resonator other than the resonator for inputting/outputting the signal are located at mutually-opposing edges of the dielectric plate respectively.

Also, each of the openings for defining the resonance region of the resonator other than the resonator for inputting/outputting the signal is substantially rectangular and extends in the direction of a magnetic field of a resonance mode generated in the resonance region.

With this configuration, electrode patterns can be symmetrically placed with respect to the dielectric plate. As a result, a spurious excitation is less likely to occur, generation of a spurious mode can be suppressed, and thus deterioration in the characteristics due to the spurious mode can be effectively prevented. Also, the accuracy of the size of an electrode formed on the dielectric plate depends on the accuracy of the size of the dielectric plate formed based on a motherboard. Thus, an electrode forming method in which the accuracy of pattern forming is poor can be adopted, and variation in the electrical characteristic can be prevented. Furthermore, a short-circuit surface of an electrode does not exist in the resonance regions performing inputting/outputting. Accordingly, a dielectric resonator device in which a current density is low and a nonloaded Q is high can be realized.

Further, the area of the dielectric plate can be used more efficiently and the resonator device can be miniaturized. Also, the coupling between adjoining resonators is increased and thus the passband of the filter can be broadened.

Preferably, each of the openings for defining the resonance region of the resonator other than the resonator for inputting/outputting the signal does not have an opening edge and is rotationally-symmetric substantially square or substantially circular in which a portion is chamfered.

With this arrangement, a multi-resonance mode resonator can be formed and the dielectric plate can be miniaturized accordingly. Thus, a compact and lightweight dielectric resonator device can be obtained.

A dielectric filter of the present invention comprises the above-described dielectric resonator device; an input/output substrate, the upper surface thereof being provided with a mounting region of the dielectric resonator device, a strip line coupled with a resonator for inputting/outputting a signal of the dielectric resonator device, and a ground electrode, and the lower surface thereof being provided with a ground electrode serving as a conductive plain separated by a predetermined distance from the lower surface of the dielectric resonator device; a first conductive member for connecting an electrode on the upper surface of the dielectric resonator device with the ground electrode on the input/output substrate; and a second conductive member serving as a conductive plain separated by a predetermined distance from the upper surface of the dielectric resonator device.

With this configuration, a compact and lightweight dielectric filter can be obtained without increasing the number of components.

A dielectric duplexer of the present invention comprises a transmission filter through which a transmission signal passes and a reception filter through which a reception signal passes. At least one of the transmission and reception filters is formed by the above-described dielectric filter. Accordingly, a compact and lightweight dielectric duplexer can be formed.

A communication apparatus of the present invention comprises a filter for a communication signal, the filter including at least one of the dielectric filter and the dielectric duplexer. Accordingly, the electrode pattern of the mounting board can be standardized so that a compact and low-cost communication apparatus can be obtained.

DESCRIPTION OF THE PREFERRED EMBODIMENTS

The configuration of a dielectric filter according to a first embodiment will be described with reference to FIGS. 1A, 1B, and 2.

Figure 1A:
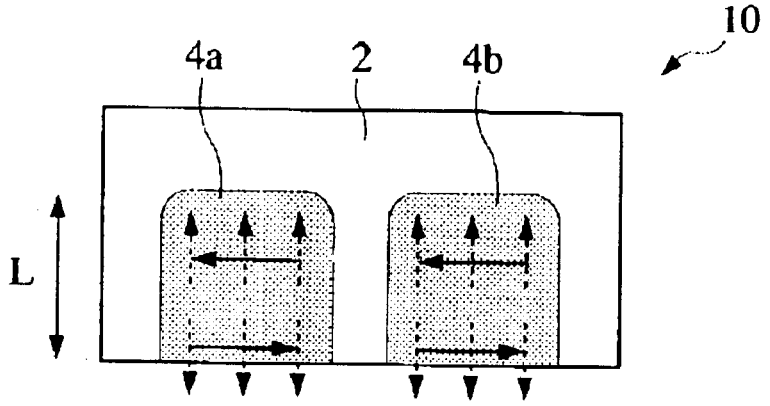
FIGS. 1A and 1B are a plan view and a cross-sectional view of a critical portion of a dielectric filter according to a first embodiment of the present invention.
Figure 1B:
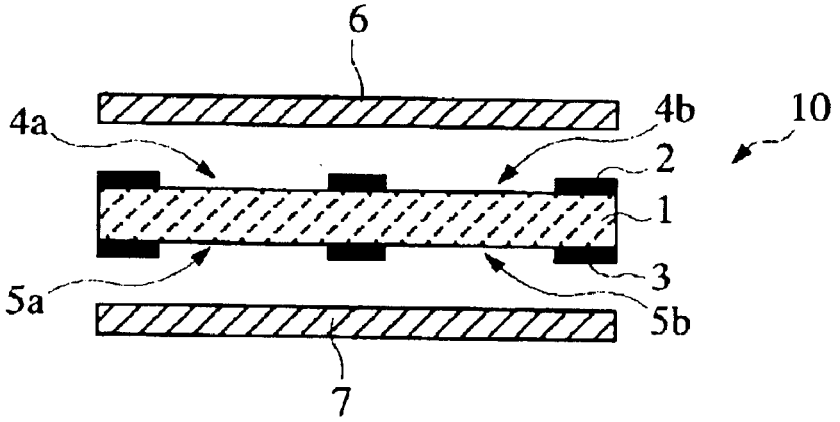

FIG. 1A is a plan view showing a dielectric resonator device 10 used for the dielectric filter, and FIG. 1B is a cross-sectional view of the dielectric filter. In FIG. 1B, reference numeral 1 denotes a rectangular dielectric plate. Electrodes 2 and 3 are provided on both principal surfaces of the dielectric plate 1. Substantially rectangular electrode openings 4*a*, 4*b*, 5*a*, and 5*b* are formed in the electrodes 2 and 3, such that the opening 4*a* faces the opening 5*a* and the opening 4*b* faces the opening 5*b*. Also, conductive plates 6 and 7 sandwich the dielectric resonator device 10 with a predetermined space therebetween.

With this configuration, as shown in FIG. 1A, portions sandwiched by the mutually-opposing electrode openings in the dielectric plate 1 function as the main resonance regions, that is, as resonators.

In FIG. 1A, arrows in solid lines indicate the directions of an electric field and arrows in broken lines indicate the directions of a magnetic field. The portions sandwiched by the electrode openings of the dielectric plate function as rectangular slot-mode dielectric resonators. One edge of each of the electrode openings 4*a*, 4*b*, 5*a*, and 5*b* is open in one edge of the dielectric plate 1. Therefore, when a wavelength in a used frequency in the dielectric plate is indicated by $\lambda$, the resonators function as one-edge open ($\frac{3}{4}$) $\lambda$ resonators. Also, the two adjoining resonators are coupled in the electric field (capacitive coupling).

Figure 2:
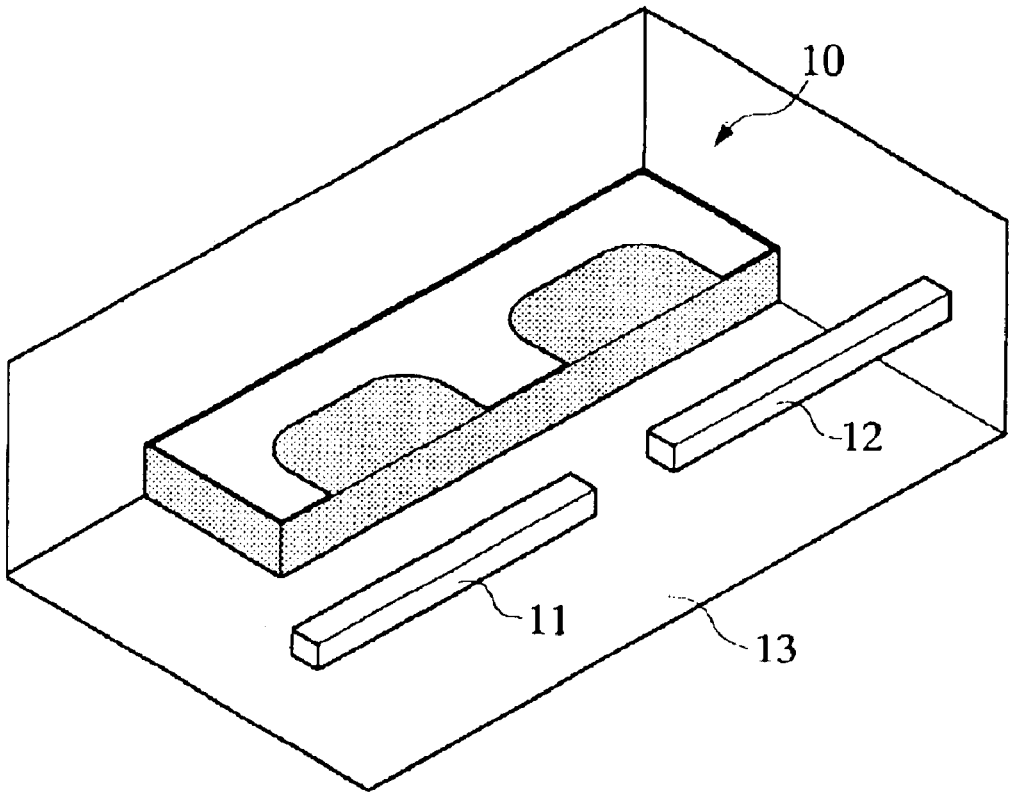
FIG. 2 is a perspective view of the dielectric filter.

FIG. 2 is a perspective view showing the configuration of the dielectric filter including the dielectric resonator device shown in FIGS. 1A and 1B. The dielectric filter includes input/output probes 11 and 12, which are provided near the open edges of the electrode openings of the dielectric resonator device 10. An external conductor 13 serves as upper and lower conductive plates for the dielectric resonator device 10. Further, the external conductor 13 shields the electromagnetic filed including the dielectric resonator device 10 and the input/output probes 11 and 12. In FIG. 2, the other three surfaces of the external conductor 13, which has six surfaces total, are not shown.

By providing the dielectric resonator device 10 and the input/output probes 11 and 12, the input/output probes 11 and 12 and the respective resonators of the dielectric resonator device 10 are coupled in the magnetic field. With this configuration, a band-pass filter with a two-stage resonator can be realized.

In this embodiment, preferably one edge of each electrode opening is opened along the same edge of the dielectric plate 1. Accordingly, if a dielectric resonator device using a different resonance frequency fo is to be formed, the dielectric plate 1 of the same size can be used. In this case, electrode openings having a different length L in the magnetic field direction are provided in both principal surfaces of the dielectric plate 1. Accordingly, the size of the entire dielectric resonator device need not be changed. Further, the components can be used in common and the electrode pattern of a mounting board can be standardized.

Figure 3:
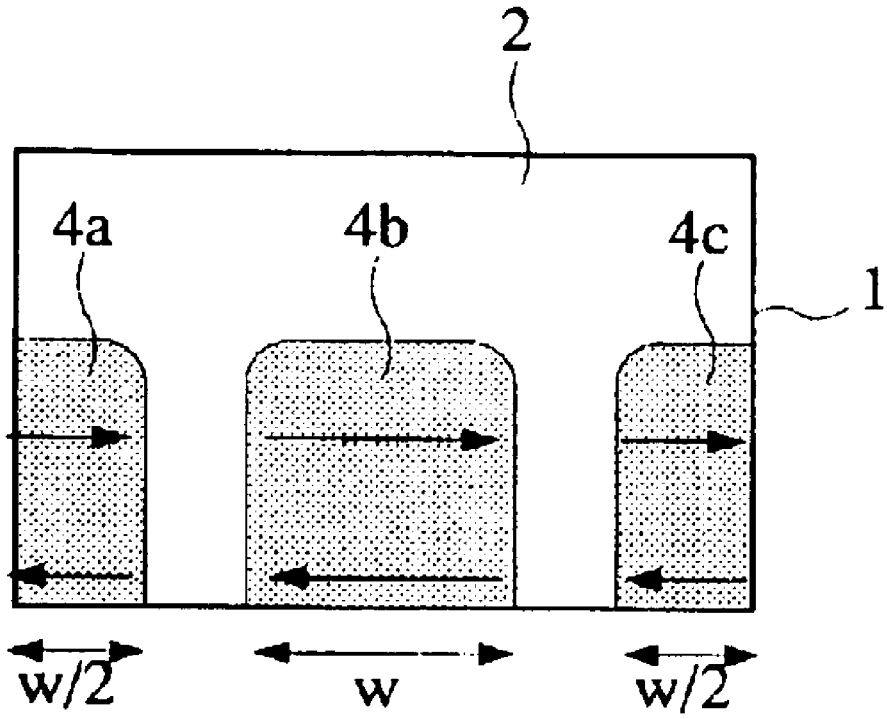
FIG. 3 is a plan view of a dielectric resonator device according to a second embodiment.

FIG. 3 is a plan view showing a dielectric resonator device according to a second embodiment of the present invention. In this embodiment, electrodes having three pairs of mutually-opposing openings are formed on both principal surfaces of the dielectric plate 1. In FIG. 3, reference numeral 2 denotes an electrode which is formed on the upper surface of the dielectric plate 1 and which includes electrode openings 4*a*, 4*b*, and 4*c*. In this embodiment, the electrode openings 4*a* to 4*c* are open in one edge of the dielectric plate 1. In addition, the electrode openings 4*a* and 4*c* have ends open along the shorter sides of the dielectric plate 1. Further, the width w in the electric field direction of the electrode openings 4*a* and 4*c* is preferably set to be substantially ½ of that of the electrode opening 4*b* so that the same resonance frequency as in the resonator device shown in FIG. 1 can be obtained.

With this configuration, the width in the alignment direction of each electrode opening of the dielectric plate 1 can be reduced.

Figure 4A:
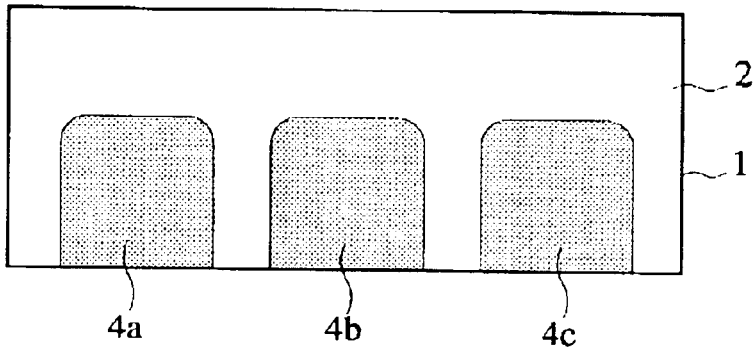
FIGS. 4A and 4B are plan views of a dielectric resonator device according to a third embodiment.
Figure 4B:
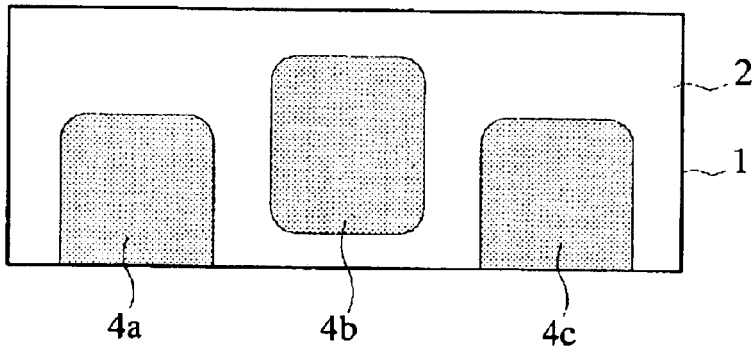

FIGS. 4A and 4B are plan views showing the configuration of a dielectric resonator device according to a third embodiment of the present invention. In FIG. 4A, electrodes including three pairs of mutually-opposing openings are formed on both principal surfaces of the dielectric plate 1. In FIG. 4A, reference numeral 2 denotes an electrode which is formed on the upper surface of the dielectric plate 1 and which includes electrode openings 4*a*, 4*b*, and 4*c*. With this alignment, a multistage resonator can be realized.

Also, in FIG. 4B, electrodes including three pairs of mutually-opposing openings are formed on both principal surfaces of the dielectric plate 1. Further, a central opening 4*b* and the opposing opening are not open in any edge in the dielectric plate 1 and are closed along all edges. With this arrangement, an unnecessary coupling between a resonator other than a resonator for inputting/outputting a signal and the input/output probe can be suppressed.

Figure 5A:
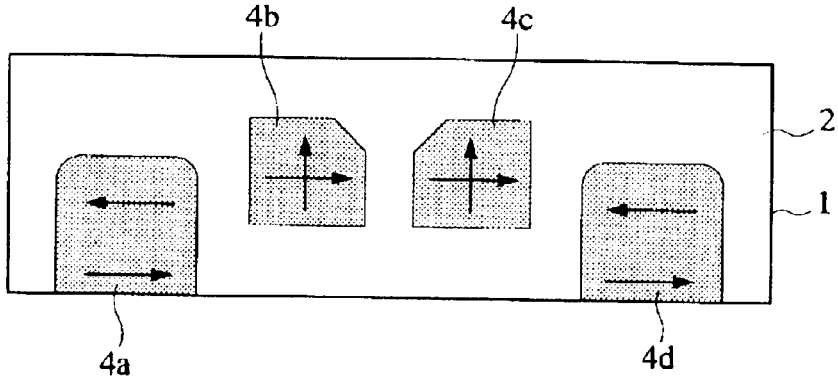
FIGS. 5A and 5B are plan views of a dielectric resonator device according to a fourth embodiment.
Figure 5B:
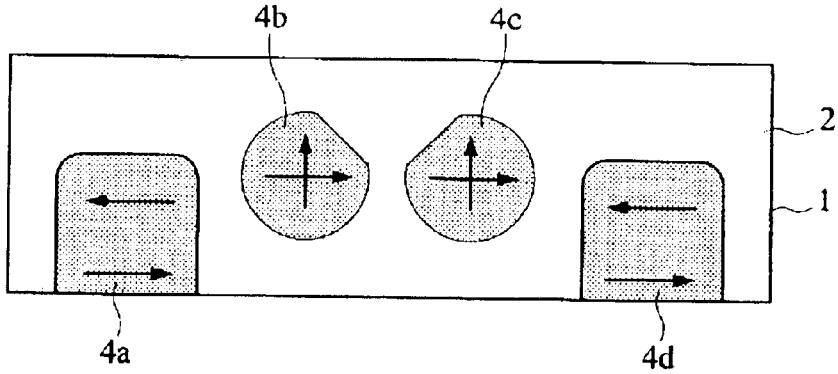

FIGS. 5A and 5B are plan views showing the configuration of a dielectric resonator device according to a fourth embodiment of the present invention. In FIG. 5A, electrodes including four pairs of mutually-opposing openings are formed on both principal surfaces of the dielectric plate 1. Four openings 4*a*, 4*b*, 4*c*, and 4*d* are formed in the electrode 2, which is formed on the upper surface of the dielectric plate 1.

In FIG. 5A, openings 4*b* and 4*c* and their opposing openings, forming resonators other than resonators for inputting/outputting a signal are substantially square-shaped, and one corner of each opening is preferably chamfered. In FIG. 5A, arrows in solid lines indicate the directions of the electric field. As can be seen, the resonators formed by the openings 4*b* and 4*c* function as double-mode resonators of a TE110 mode, in which an electric field in a vertical direction and in a horizontal direction exists. Also, by chamfering one corner of each opening, the 90°-rotational symmetry collapses, the degeneration relationship of the double mode is released, and as a result, the resonator functions as a coupled two-stage resonator. Therefore, the opening 4*b* functions as second-stage and third-stage resonators and the opening 4*c* functions as fourth-stage and fifth-stage resonators.

The opening 4*a* functions as a first-stage resonator and the opening 4*d* functions as a sixth-stage resonator. Further, the first and second stages and the fifth and sixth stages are coupled in an electric field (capacitive coupling), respectively. The third and fourth stages are coupled in a magnetic field (inductive coupling). Also, the second and fifth stages are coupled in an electric field (capacitive coupling) by skipping.

In FIG. 5B, openings 4*b* and 4*c* and their opposing openings, forming resonators other than resonators for inputting/outputting a signal are circular-shaped, and a portion of each opening is preferably chamfered. In this case, the portions between the two electrode openings 4*b* and 4*c* and their opposing openings function as double-mode resonators, having an HE110x mode in which the electric field extends in the longer-side direction of the dielectric plate 1 and an HE110y mode in which the electric field extends in the shorter-side direction of the dielectric plate 1.

Next, the configuration of a dielectric filter according to a fifth embodiment of the present invention will be described with reference to FIGS. 6 and 7A to 7C.

Figure 6:
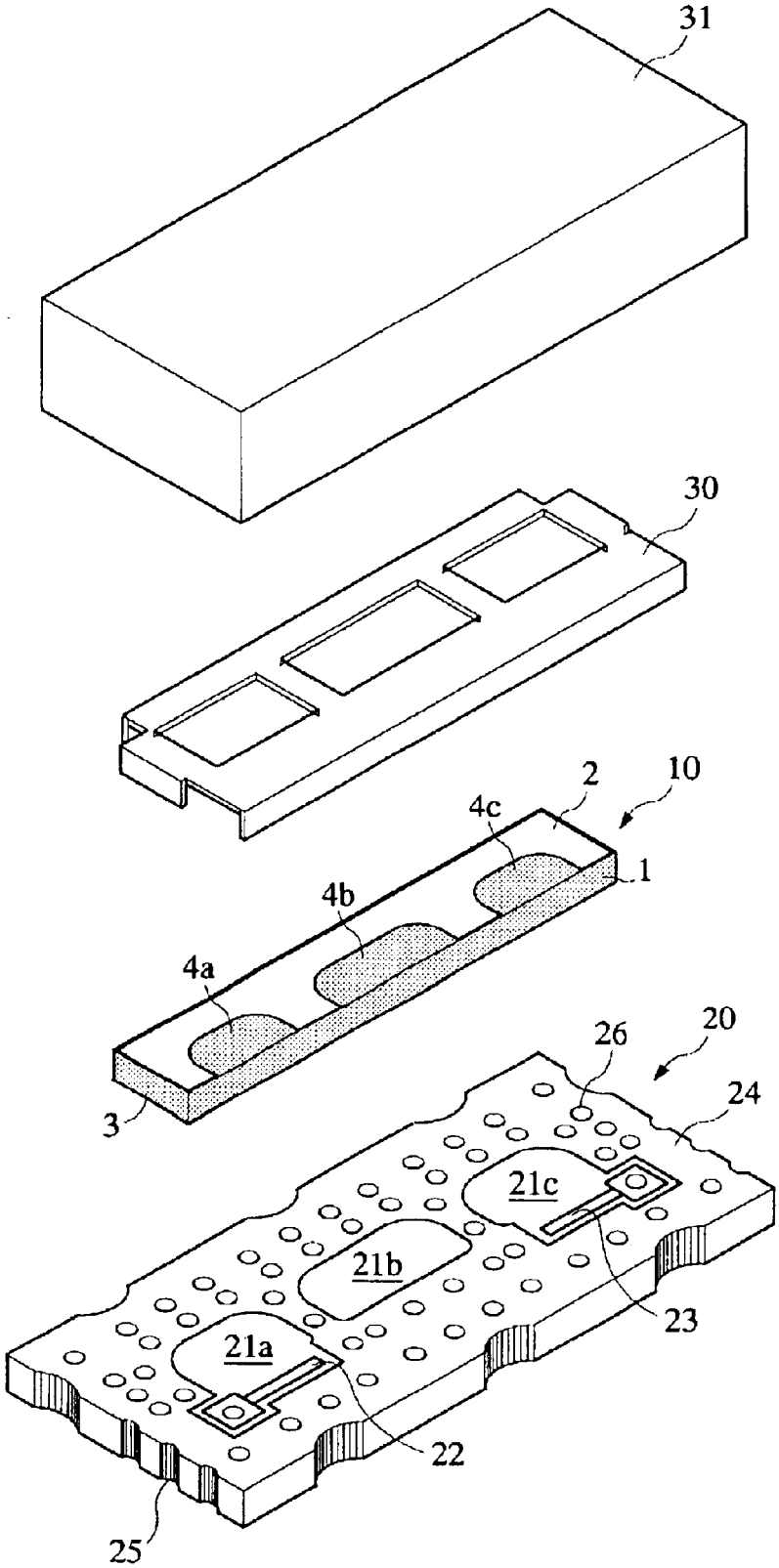
FIG. 6 is an exploded perspective view showing the configuration a dielectric filter according to a fifth embodiment.
Figure 7A:
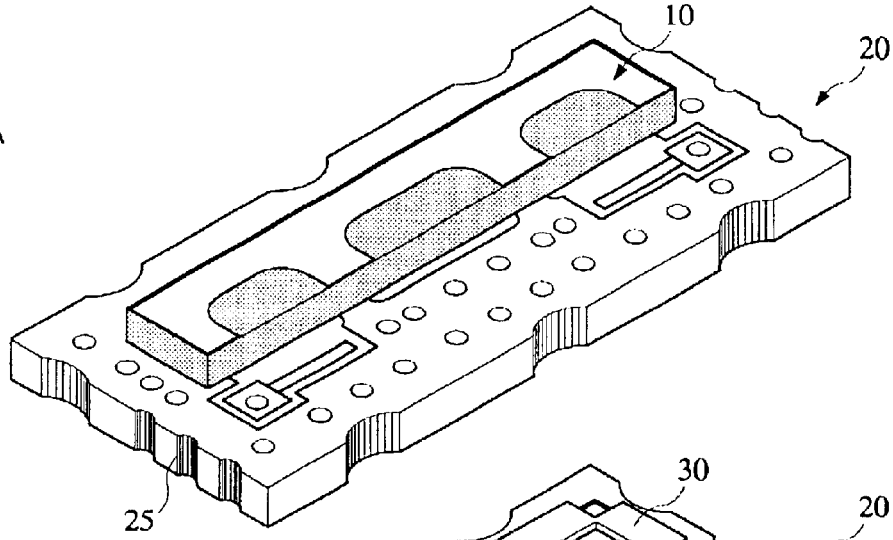
FIGS. 7A to 7C are perspective views showing a process of assembling the dielectric filter.
Figure 7B:
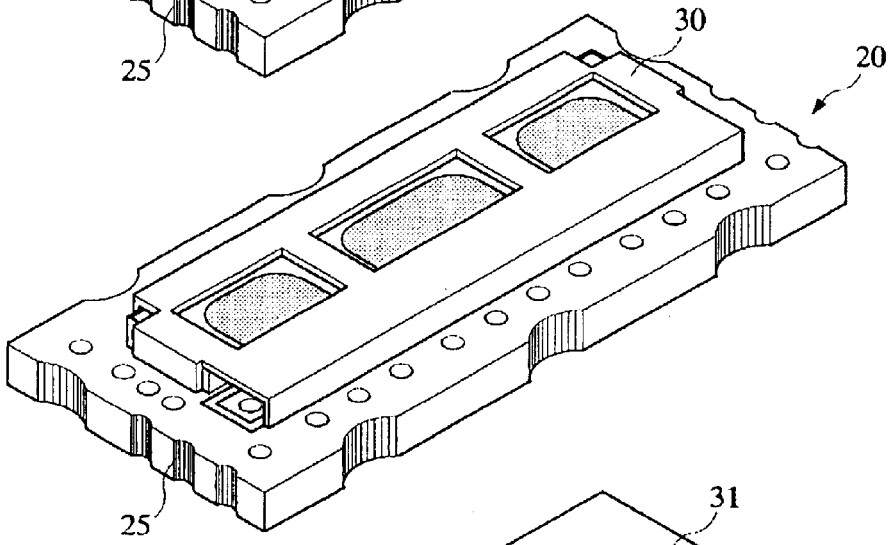
Figure 7C:
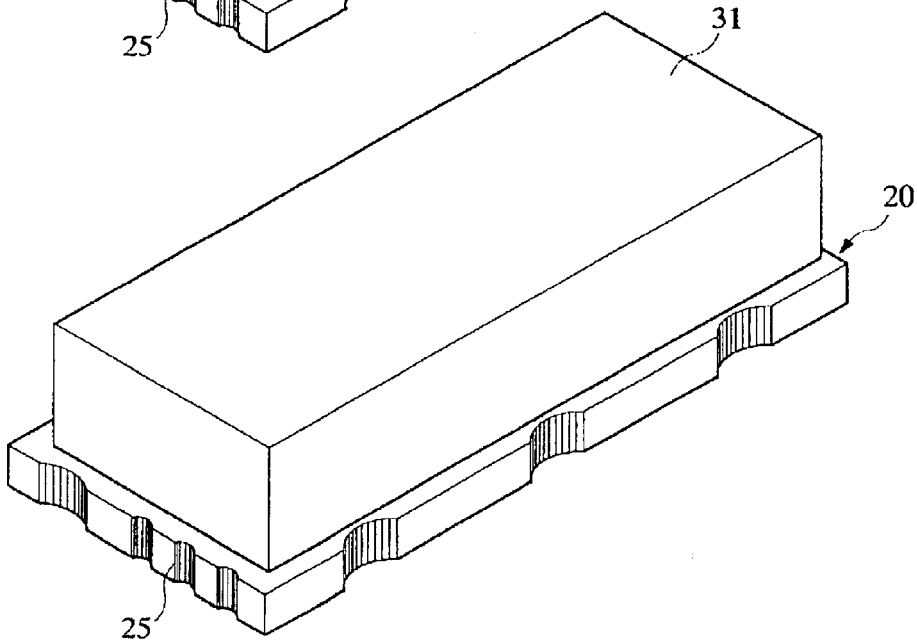

FIG. 6 is an exploded perspective view of the dielectric filter and FIGS. 7A to 7C show each state in an assembling process. In FIGS. 6 and 7A to 7C, reference numeral 10 denotes a dielectric resonator device having the same configuration as that shown in FIG. 4A. Reference numeral 20 denotes an input/output substrate for mounting the dielectric resonator device 10. The input/output substrate 20 is an insulating substrate, and is provided with strip lines 22 and 23 serving as input/output probes on the surface for mounting the dielectric resonator device (upper surface in the figure). Also, a ground electrode 24 is preferably provided on the upper surface of the input/output substrate 20. Further, electrode openings 21*a*, 21*b*, and 21*c* are formed in the upper surface of the input/output substrate 20 so that the openings formed in the mounted surface (lower surface) of the dielectric resonator device 10 do not contact the ground electrode 24. Also, a ground electrode is preferably formed on the substantially whole area of the lower surface of the input/output substrate 20. In order to electrically connect the ground electrode on the lower surface and the ground electrode 24 on the upper surface, a plurality of through-holes 26, each having a conductive film in its inner surface, are preferably formed in the input/output substrate 20.

Furthermore, an extension electrode, which is in conduction with the strip line 22 through the through-hole, is provided on the lower surface of the input/output substrate 20, and the electrode is extended to an input/output terminal 25 formed in an end surface of the input/output substrate 20. That is, the input/output terminal 25 in the figures is in conduction with the strip line 22. Likewise, another input/output terminal which is in conduction with the strip line 23 is formed in the right back end surface of the input/output substrate 20 in FIG. 6.

In FIG. 6, reference numeral 30 denotes an earth cover (first conductive member) for establishing conduction between the electrode formed on the upper surface of the dielectric resonator device 10 and the ground electrode on the input/output substrate 20. Also, reference numeral 31 denotes a cap (second conductive member) for covering the upper side of the input/output substrate 20 so as to serve as a conductive plate above the dielectric resonator device 10.

In order to assemble these members, the dielectric resonator device 10 is mounted on the upper surface of the input/output substrate 20, as shown in FIG. 7A. Then, the earth cover 30 is mounted as shown in FIG. 7B. Accordingly, conduction between the electrode formed on the upper surface of the dielectric resonator device 10 and the ground electrode formed on the input/output substrate 20 can be established via the earth cover 30.

After that, as shown in FIG. 7C, the cap 31 is electrically and mechanically coupled to the ground electrode of the input/output substrate 20.

In this way, the dielectric resonator device 10, the strip lines 22 and 23, and the upper conductive plate are provided on the upper surface of the input/output substrate 20. Also, the ground electrode formed on the lower surface of the input/output substrate 20 functions as a conductive plate which is separated by a predetermined distance from the lower surface of the dielectric resonator device 10.

Next, the configuration of a dielectric filter according to a sixth embodiment of the present invention will be described with reference to FIGS. 8A and 8B.

Figure 8A:
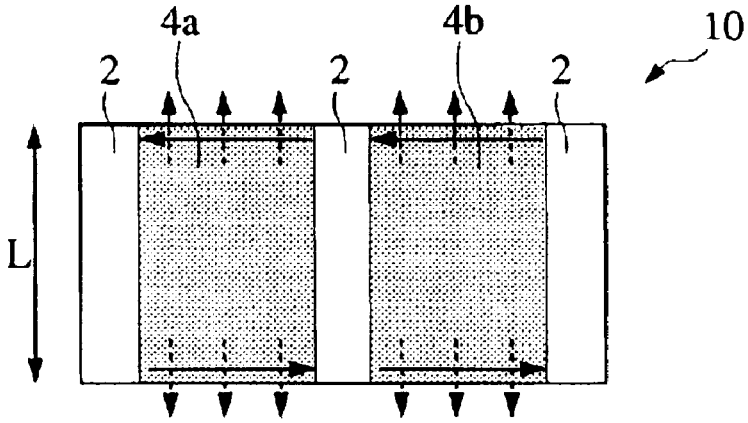
FIGS. 8A and 8B are a plan view and a cross-sectional view of a dielectric resonator device according to a sixth embodiment.
Figure 8B:
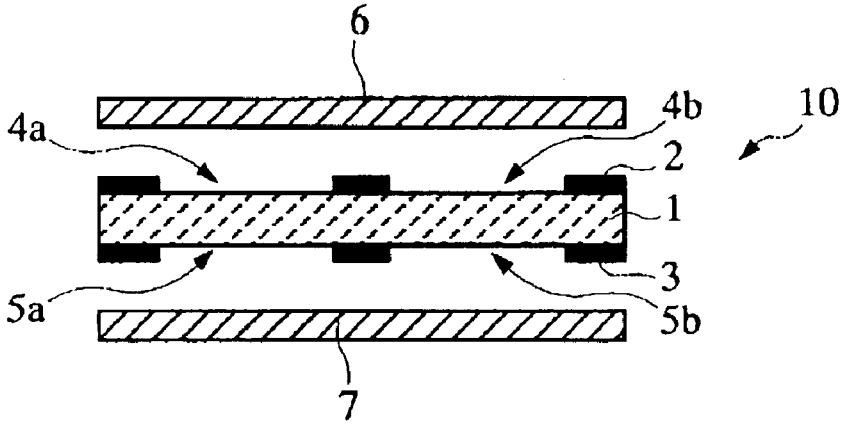

FIG. 8A is a plan view of a dielectric resonator device used for the dielectric filter and FIG. 8B is a cross-sectional view of the dielectric filter. In FIG. 8B, reference numeral 1 denotes a rectangular dielectric plate. Electrodes 2 and 3 are provided on both principal surfaces of the dielectric plate 1, respectively. Mutually-opposing rectangular electrode openings 4*a*, 4*b*, 5*a*, and 5*b* are formed in the electrodes 2 and 3. Also, conductive plates 6 and 7 sandwich the dielectric resonator device 10 with a predetermined space therebetween.

With this configuration, as shown in FIG. 8A, portions sandwiched by the mutually-opposing electrode openings in the dielectric plate 1 function as main resonance regions, that is, as resonators.

In FIG. 8A, arrows in solid lines indicate the directions of an electric field and arrows in broken lines indicate the directions of a magnetic field. The portions sandwiched by the electrode openings of the dielectric plate function as rectangular slot-mode dielectric resonators. Unlike in the embodiment shown in FIGS. 1A and 1B, mutually-opposing edges of each of the electrode openings 4*a*, 4*b*, 5*a*, and 5*b* are open along mutually-opposing edges of the dielectric plate 1. Therefore, when a wavelength in a used frequency in the dielectric plate 1 is indicated by λ, the resonators function as both-edge open (½) λ resonators. Also, the two adjoining resonators are coupled in the electric field (capacitive coupling). By providing a unit to be coupled in a magnetic field with each of the two resonators along one longer side of the dielectric plate 1, a band-pass filter including a two-stage resonator can be realized.

In this way, when the mutually-opposing edges of each electrode opening are open along edges of the dielectric plate 1, electrode patterns can be symmetrically placed with respect to the dielectric plate 1. As a result, a spurious excitation is less likely to occur, generation of a spurious mode can be suppressed, and thus deterioration in the characteristics due to the spurious mode can be effectively prevented. Also, the accuracy of the size of an electrode formed on the dielectric plate depends on the accuracy of the size of the dielectric plate formed based on a motherboard, and does not depend on the accuracy of forming of an electrode pattern. Therefore, even if the electrode is formed by a thick film printing, in which the accuracy of pattern forming is poor, variation in the electrical characteristic can be prevented. Furthermore, a short-circuit surface of an electrode does not exist in the resonance regions. Accordingly, a dielectric resonator device in which a current density is low and a nonloaded Q is high can be realized.

In this embodiment, each electrode opening is open in the same edge of the dielectric plate 1. Accordingly, if a dielectric resonator device using a different resonance frequency fo is to be formed, a dielectric plate of the same size in the longer-side direction can be used and only the length L in a magnetic field direction should be defined on both principal surfaces. Thus, the electrode pattern of a mounting board can be standardized.

Next, the configuration of a dielectric filter according to a seventh embodiment of the present invention will be described with reference to FIG. 9.

Figure 9:
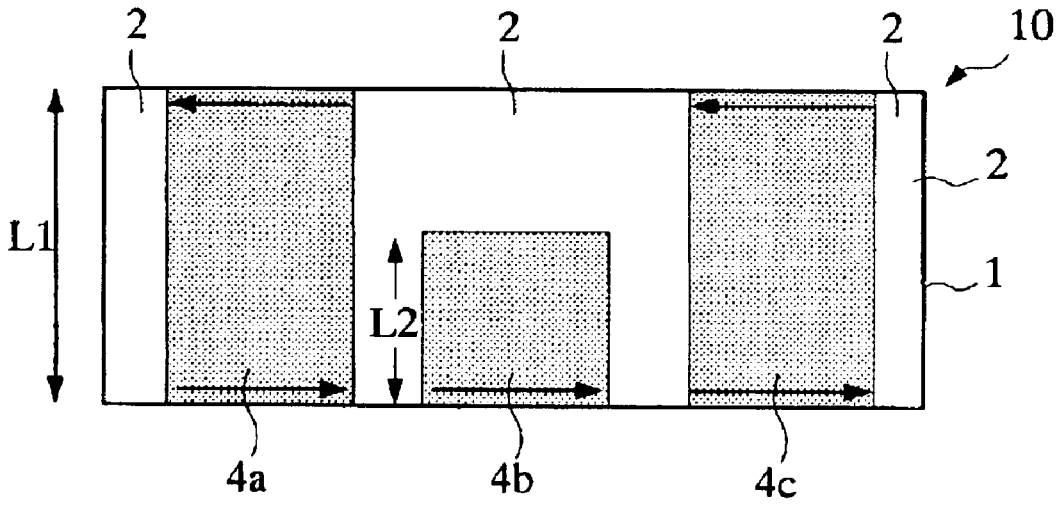
FIG. 9 is a plan view of a dielectric resonator device according to a seventh embodiment.

FIG. 9 is a plan view of a dielectric resonator device used for the dielectric filter. In FIG. 9, reference numeral 10 denotes a dielectric resonator device including a rectangular dielectric plate 1, an electrode being provided on each of both principal surfaces thereof. Reference numeral 2 denotes an electrode provided on the upper surface of the dielectric plate 1. Rectangular electrode openings 4*a*, 4*b*, and 4*c* are formed in the electrode 2. An electrode which faces the electrode 2 and which has a plane-symmetrical pattern is formed on the lower surface of the dielectric plate 1.

In FIG. 9, arrows in solid lines indicate the directions of an electric field. With this configuration, portions sandwiched by the mutually-opposing electrode openings in the dielectric plate 1 function as main resonance regions, that is, as resonators. In the electrode openings 4*a* and 4*c* and the opposing electrode openings, mutually-opposing edges are open along the edges of the dielectric plate 1. Thus, as in the dielectric resonator device shown in FIGS. 8A and 8B, the resonators function as both-edge open (½) λ resonators. Further, one edge of the electrode opening 4*b* and the opposing electrode opening are open along an edge of the dielectric plate 1. Thus, the resonator of this portion functions as a one-end open/other-end short-circuited (¼) λ resonator. In the three resonators, adjoining resonators are coupled in an electric field (capacitive coupling). Accordingly, by providing a unit to be coupled in a magnetic field with each of resonators along a longer side of the dielectric plate 1, a band-pass filter including a three-stage resonator can be realized. Herein, the resonance frequency of the first-stage resonator and the third-stage resonator mainly depends on the length L1 in the shorter-side of the dielectric plate 1. Also, the resonance frequency of the second-stage resonator is independent from the first- and third-stage resonators, and the resonance frequency depends on the length L2 of the opening 4*b* or the opposing opening in the lower surface.

In this case, a plurality of types of dielectric filters in which the resonance frequency of the second-stage resonator is different can be formed by using a common dielectric plate. Thus, the components can be used in common and the electrode pattern of a mounting board can be standardized.

Next, the configuration of a dielectric filter according to an eighth embodiment of the present invention will be described with reference to FIGS. 10A and 10B.

Figures 10A, 10B:
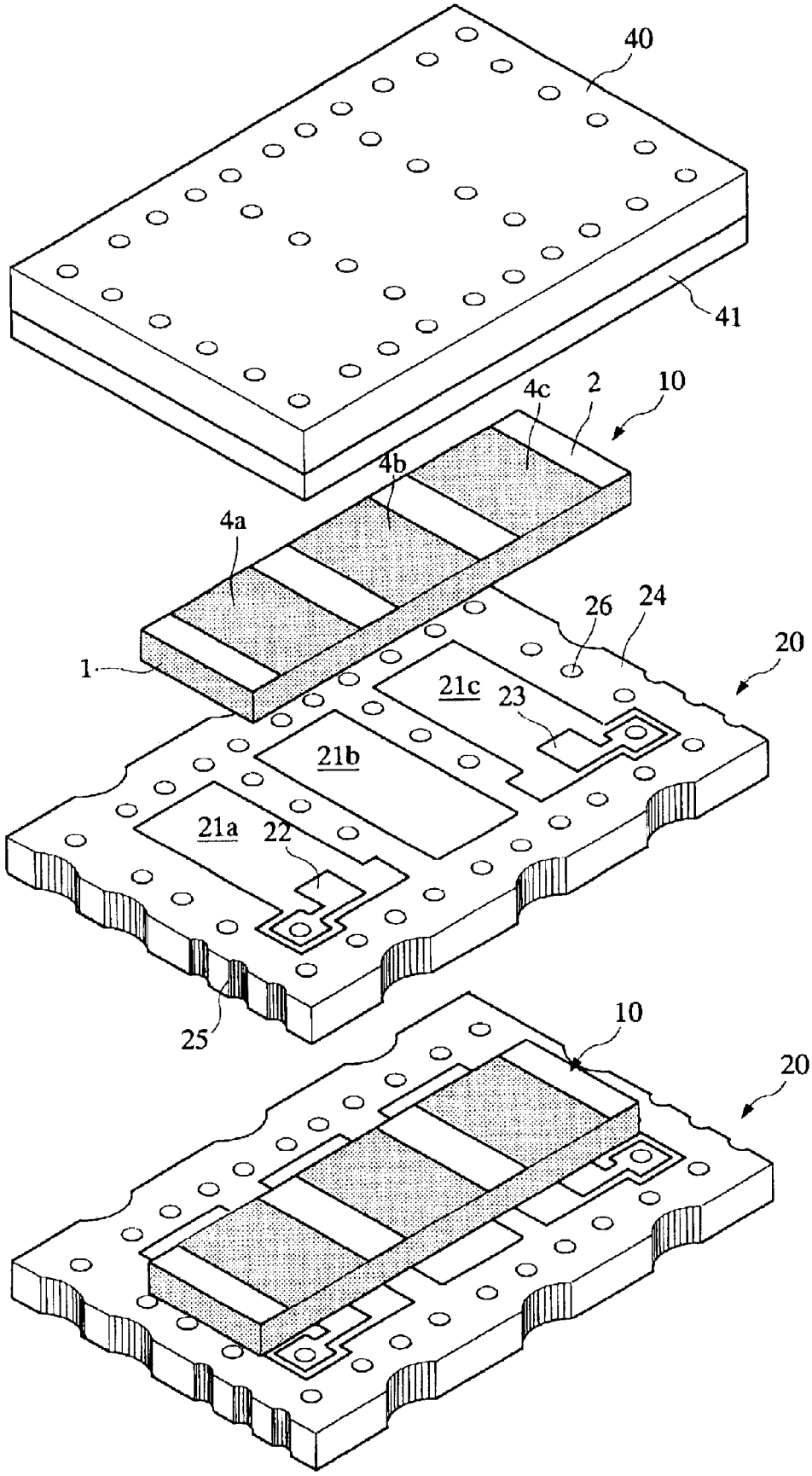
FIGS. 10A and 10B are exploded perspective views showing the configuration of a dielectric filter according to an eighth embodiment.

FIG. 10A is an exploded perspective view of the dielectric filter and FIG. 10B shows a state of an assembling process. In FIGS. 10A and 10B, reference numeral 10 denotes a dielectric resonator device having a three-stage resonator similar to that shown in FIG. 9, in which each resonator functions as a (½) λ resonator. The resonance frequency of each resonator is, for example, 26 GHz. Reference numeral 20 denotes an input/output substrate for mounting the dielectric resonator device 10. The input/output substrate 20 preferably is an insulating substrate, and is provided with strip lines 22 and 23 serving as input/output probes on the surface for mounting the dielectric resonator device 10 (upper surface in the figure). Also, a ground electrode 24 is preferably provided on the upper surface of the input/output substrate 20. Further, electrode openings 21*a*, 21*b*, and 21*c* are formed in the upper surface of the input/output substrate 20 so that the openings formed in the mounted surface (lower surface) of the dielectric resonator device 10 do not contact the ground electrode 24. Also, a ground electrode is preferably formed on the substantially whole area of the lower surface of the input/output substrate 20. In order to electrically connect the ground electrode on the lower surface and the ground electrode 24 on the upper surface, a plurality of through-holes 26, each having a conductive film in its inner surface, are preferably formed in the input/output substrate 20.

Furthermore, an extension electrode, which is in conduction with the strip line 22 through the through-hole, is provided on the lower surface of the input/output substrate 20, and the electrode is extended to an input/output terminal 25 formed in an end surface of the input/output substrate 20. That is, the input/output terminal 25 in the figures is in conduction with the strip line 22. Likewise, another input/output terminal which is in conduction with the strip line 23 is formed in the right back end surface of the input/output substrate 20 in FIGS. 10A and 10B.

Also, reference numeral 40 denotes an upper substrate having a configuration similar to a turned-over input/output substrate 20. Electrode openings are formed in the lower surface of the upper substrate 40 so that the electrode 2 on the upper surface of the dielectric resonator device 10 is not in contact with an electrode on the lower surface of the upper substrate 40. A ground electrode is preferably formed in the regions other than the electrode openings. Further, a conductive or insulating frame spacer 41 is preferably provided for keeping a predetermined space between the upper substrate 40 and the input/output substrate 20.

FIG. 10B shows a state where the dielectric resonator device 10 is mounted on the upper surface of the input/output substrate 20. After the dielectric resonator device 10 is mounted on the upper surface of the input/output substrate 20, the upper substrate 40 including the spacer 41 is coupled electrically and mechanically.

In this way, the dielectric resonator device 10 and the strip lines 22 and 23 are provided on the upper surface of the input/output substrate 20. Also, the ground electrode of the upper substrate 40 serves as a conductive plate separated from the upper surface of the dielectric resonator device 10 by a predetermined distance, and the ground electrode on the lower surface of the input/output substrate 20 serves as a conductive plate separated from the lower surface of the dielectric resonator device 10 by a predetermined distance. Accordingly, a band-pass filter of 26 GHz can be realized.

Next, the configuration of a dielectric duplexer according to a ninth embodiment of the present invention will be described with reference to FIG. 11.

Figure 11:
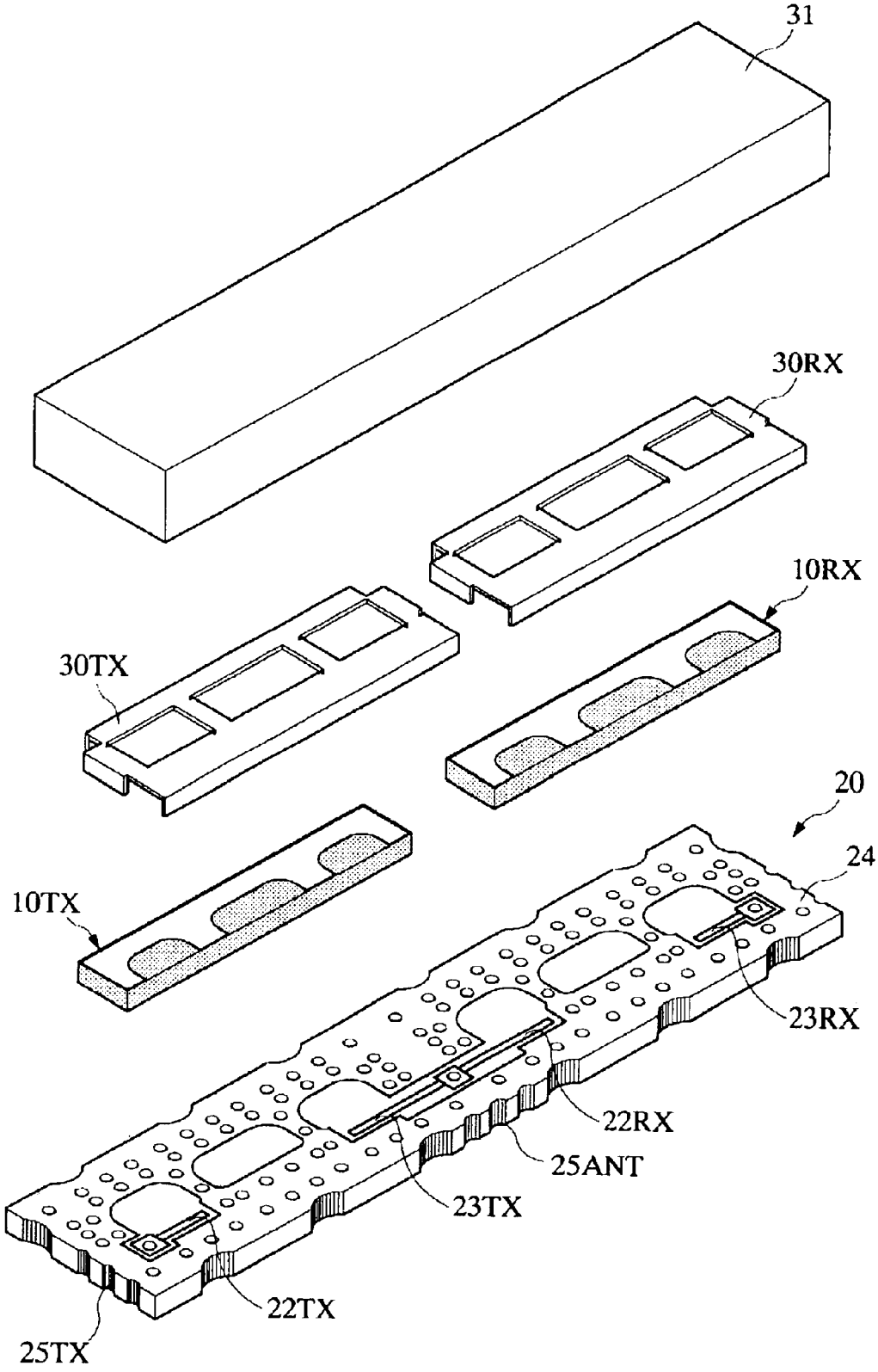
FIG. 11 is an exploded perspective view showing the configuration of a dielectric duplexer according to a ninth embodiment.

FIG. 11 is an exploded perspective view of the dielectric duplexer. In FIG. 11, reference numeral 10TX denotes a dielectric resonator device used as a transmission filter, and reference numeral 10RX is a dielectric resonator device used as a reception filter. Reference numeral 20 denotes an input/output substrate for mounting the dielectric resonator devices 10TX and 10RX. The upper surface of the input/output substrate 20 is provided with strip lines 22TX and 23TX coupled with two resonators of the dielectric resonator device 10TX respectively, and strip lines 22RX and 23RX coupled with two resonators of the dielectric resonator device 10RX respectively. Also, as in the dielectric filter shown in FIG. 6, a ground electrode 24 is formed on the input/output substrate 20.

Input/output terminals which are in conduction with the strip lines 22TX, 23TX, 22RX, and 23RX, respectively, via the lower surface of the input/output substrate 20 are formed in end surfaces of the input/output substrate 20. In FIG. 11, reference numeral 25TX denotes an input/output terminal for outputting a transmission signal, the input/output terminal 25TX being in conduction with the strip line 22TX. Reference numeral 25ANT denotes an input/output terminal serving as an antenna terminal, which is in conduction with the connecting point of the strip lines 23TX and 22RX. Also, an input/output terminal for outputting a reception signal, which is in conduction with the strip line 23RX is formed on the right back end surface of the input/output substrate 20 in FIG. 11.

Reference numerals 30TX and 30RX denote earth covers which are provided on the upper surface of the dielectric resonator devices 10TX and 10RX respectively so that the electrodes on the upper surfaces of the dielectric resonator devices 10TX and 10RX are grounded. Further, reference numeral 31 denotes a cap provided on the upper surface of the input/output substrate 20.

By assembling the components shown in FIG. 11 in the same way as in the above-described dielectric filter, a dielectric duplexer including a transmission filter and a reception filter can be realized.

Figure 12:
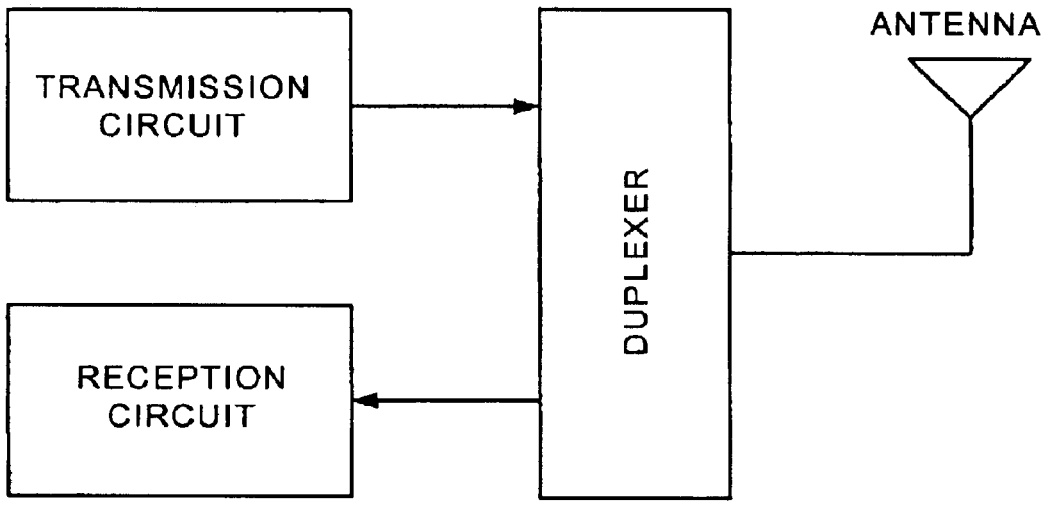
FIG. 12 is a block diagram showing the configuration of a communication apparatus according to a tenth embodiment.
Figure 13A:
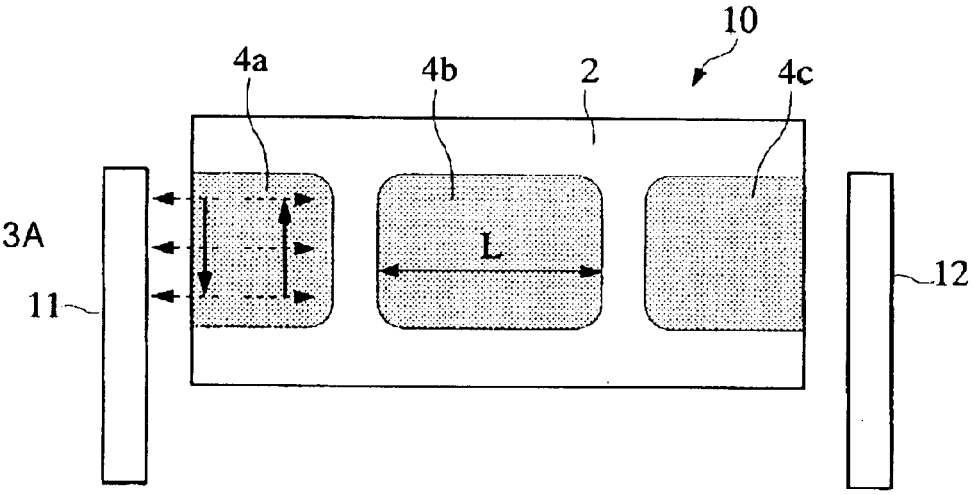
FIGS. 13A and 13B show the configuration of a known dielectric filter.
Figure 13B:
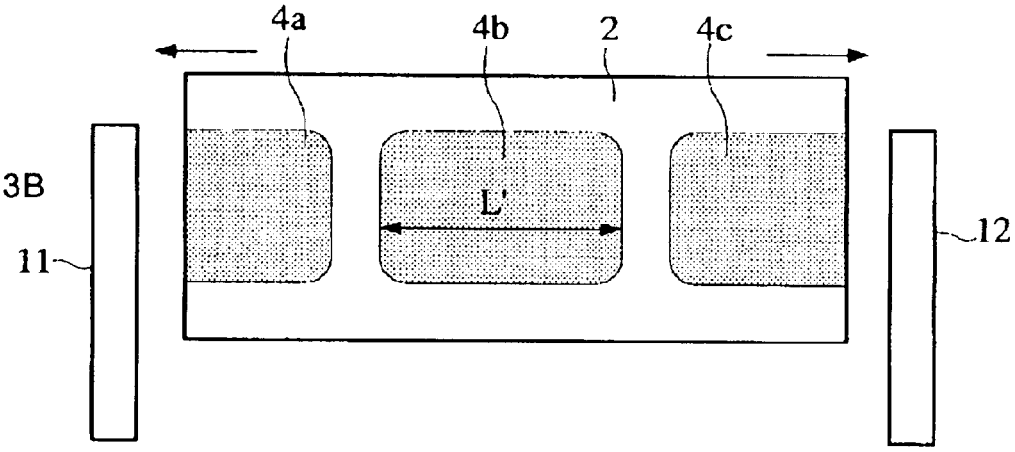

FIG. 12 is a block diagram showing the configuration of a communication apparatus according to a tenth embodiment. Herein, the dielectric duplexer including the transmission filter and the reception filter shown in FIG. 11 is used as a duplexer. The dielectric duplexer includes a transmission circuit and a reception circuit so that a transmission signal is input to a transmission signal input terminal of the dielectric duplexer and a reception signal from a reception signal output terminal of the dielectric duplexer is output to the reception circuit. Further, an antenna is connected to an antenna terminal of the dielectric duplexer. In this way, the communication apparatus is configured.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric resonator device comprising:

a substantially rectangular dielectric plate having upper and lower opposed surfaces;

a respective electrode provided on each of the upper and lower opposed surfaces of the dielectric plate; and at least two mutually-opposing openings formed in the respective electrodes, wherein respective portions between the mutually-opposing openings define main resonance regions which function as respective resonators, and wherein at least one of the mutually-opposing openings defining the main resonance regions of the resonators is a resonator for externally inputting/outputting a signal and being substantially rectangular, and at least one edge of the at least two mutually-opposing openings is located along the same edge of the dielectric plate.

2. A dielectric filter comprising:

the dielectric resonator device according to claim 1;

an input/output substrate, an upper surface thereof being provided with a mounting region for the dielectric resonator device, a strip line coupled with the resonator for inputting/outputting the signal of the dielectric resonator device, and a first ground electrode, and a lower surface thereof being provided with a second ground electrode serving as a conductive plane separated by a predetermined distance from a lower surface of the dielectric resonator device;

a first conductive member for connecting the electrode on the upper surface of the dielectric resonator device with the first ground electrode on the input/output substrate; and a second conductive member serving as a conductive plane separated by a predetermined distance from the upper surface of the dielectric resonator device.

3. A dielectric resonator device comprising:

a substantially rectangular dielectric plate having upper and lower opposed surfaces;

a respective electrode provided on each of the upper and lower opposed surfaces of the dielectric plate; and at least two mutually-opposing openings formed in the respective electrodes, wherein respective portions between the mutually-opposing openings define main resonance regions which function as respective resonators, wherein at least one of the mutually-opposing openings defining the main resonance regions of the resonators is a resonator for externally inputting/outputting a signal and being substantially rectangular, and at least one edge of the at least one of the at least two mutually-opposing openings is located at one edge of the dielectric plate, and wherein an electrically open end of a resonator other than the resonator for inputting/outputting the signal and an electrically open end of the resonator for inputting/outputting the signal are located at the same edge of the dielectric plate.

4. A dielectric resonator device comprising:

a substantially rectangular dielectric plate having upper and lower opposed surfaces;

a respective electrode provided on each of the upper and lower opposed surfaces of the dielectric plate; and at least two mutually-opposing openings formed in the respective electrodes, wherein respective portions between the mutually-opposing openings define main resonance regions which function as respective resonators, wherein at least one of the mutually-opposing openings defining the main resonance regions of the resonators is a resonator for externally inputting/outputting a signal and being substantially rectangular, and at least one edge of the at least one of the at least two mutually-opposing openings is located at one edge of the dielectric plate, and wherein mutually-opposing electrically open ends of a resonator other than the resonator for inputting/outputting the signal are located at mutually-opposing edges of the dielectric plate respectively.

5. A dielectric resonator device comprising:

a substantially rectangular dielectric plate having upper and lower opposed surfaces;

a respective electrode provided on each of the upper and lower opposed surfaces of the dielectric plate; and at least two mutually-opposing openings formed in the respective electrodes, wherein respective portions between the mutually-opposing openings define main resonance regions which function as respective resonators, wherein at least one of the mutually-opposing openings defining the main resonance regions of the resonators is a resonator for externally inputting/outputting a signal and being substantially rectangular, and at least one edge of the at least one of the at least two mutually-opposing openings is located at one edge of the dielectric plate, and wherein an opening for defining the resonance region of a resonator other than the resonator for inputting/outputting the signal is substantially rectangular and extends in a direction of a magnetic field of a resonance mode generated in the resonance region.

6. A dielectric resonator device comprising:

a substantially rectangular dielectric plate having upper and lower opposed surfaces;

a respective electrode provided on each of the upper and lower opposed surfaces of the dielectric plate; and at least two mutually-opposing openings formed in the respective electrodes, wherein respective portions between the mutually-opposing openings define main resonance regions which function as respective resonators, wherein at least one of the mutually-opposing openings defining the main resonance regions of the resonators is a resonator for externally inputting/outputting a signal and being substantially rectangular, and at least one edge of the at least one of the at least two mutually-opposing openings is located at one edge of the dielectric plate, and wherein an opening for defining the resonance region of a resonator other than the resonator for inputting/outputting the signal does not have an electrically open end and is one of a rotationally-asymmetric substantially square pattern in which a portion is chamfered and a substantially circular pattern in which a portion is chamfered.

7. A dielectric duplexer comprising:

a transmission filter through which a transmission signal passes; and a reception filter through which a reception signal passes, wherein at least one of the transmission and reception filters is the dielectric filter according to claim 2.

8. A communication apparatus comprising:

a filter for a communication signal, wherein the filter is the dielectric filter according to claim 2.

9. A communication apparatus comprising:

a dielectric duplexer, wherein the dielectric duplexer is the dielectric duplexer according to claim 7.

* * * * *